US006635982B2

(12) United States Patent
Cho

(10) Patent No.: US 6,635,982 B2
(45) Date of Patent: Oct. 21, 2003

(54) ELECTRON GUN IN CRT

(75) Inventor: Sung Ho Cho, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 09/929,102

(22) Filed: Aug. 15, 2001

(65) Prior Publication Data

US 2002/0079818 A1 Jun. 27, 2002

(30) Foreign Application Priority Data

Dec. 23, 2000 (KR) ..... 2000-81160

(51) Int. Cl.[7] ..... H01J 29/50
(52) U.S. Cl. ..... 313/414; 313/412
(58) Field of Search ..... 313/414, 412

(56) References Cited

U.S. PATENT DOCUMENTS 5,036,258 A * 7/1991 Chen et al. ..... 313/414
5,414,323 A * 5/1995 Ucida et al. ..... 313/414
5,635,792 A * 6/1997 Jung et al. ..... 313/412
5,894,191 A * 4/1999 Kim ..... 313/412
6,492,767 B1 * 12/2002 Bae ..... 313/414

* cited by examiner

*Primary Examiner*—Vip Patel
(74) *Attorney, Agent, or Firm*—Birch, Stewart, Kolasch & Birch, LLP

(57) ABSTRACT

Electron gun in a CRT including a main lens electrode having a focus electrode and an anode for focusing electron beams emitted from cathodes onto a screen, an electrostatic field controlling body fitted in each of the focus electrode and the anode each having three electron beam pass through holes, wherein each of outer holes in the electrostatic field controlling body fitted to each of the focus electrode and the anode has a form of a combination of a circle and a rectangle with reference to a vertical axis through a center of the hole in a direction opposite for facing outer holes of the focus electrode and the anode, thereby enlarging a main lens diameter, and providing a spot substantially circular and smaller.

4 Claims, 6 Drawing Sheets

REPLACEMENT SHEET

ELECTRON GUN IN CRT

BACKGROUND OF THE INVENTION

1. Field of the Invention

The present invention relates to an electron gun in a cathode ray tube (CRT), and more particularly, to an electron gun in a CRT, in which electron beam pass through holes in an electrostatic field controlling body provided both to a focusing electrode and anode of a main lens electrode are changed, for improving a screen focusing characteristic.

2. Background of the Related Art

The CRT, a device for forming a picture by landing electron beams emitted from the electron gun on a screen, is illustrated in FIG. 1, schematically.

Referring to FIG. 1, the CRT is provided with a panel 2 fitted to a front for acting as a screen, a fluorescent surface 4 of red R, green G, and blue B fluorescent materials coated on an inside surface of the panel 2, a shadow mask 8 for selecting a color as electron beams 6 incident on the fluorescent surface 4 pass therethrough, a funnel 10 fitted to rear of the panel 2 for sustaining an inner space of the CRT at a vacuum, and a deflection yoke 12 surrounding an outer circumference of a neck part 10*a* of the funnel 10 for deflecting the electron beams 6.

The electron gun 20 is placed in the neck part 10*a* of the funnel 10 of the CRT, and provided with three independent cathodes 201, a first electrode 21 spaced a distance away from the cathodes 201, a second electrode 22, a third electrode 23, a fourth electrode 24, a fifth electrode 25, and a sixth electrode 26 spaced at fixed intervals from the first electrode 21, and a shield cup 27 above the sixth electrode 26 having a bulb space contact (B.S.C) 28 fitted thereto for electrical connection of the electron gun 20 to the funnel 10 and fastening the electron gun 20 to the neck part 10*a* of the funnel 10.

The electron gun 20 emits electrons as heaters 203 in the cathodes 201 are heated by a power supplied from respective stem pins 202 at rear end thereof, and the electrons form electron beams, which are controlled by the first electrode 21, a controlling electrode, and accelerated by the second electrode 22, an accelerating electrode. Then, the electron beams are partly focused and accelerated by a pre-focus lens formed between the second electrode 22, the third electrode 23, the fourth electrode 24, the fifth electrode 25 (a focus electrode), finally focused and accelerated by the sixth electrode 26 (anode), a final accelerating electrode, pass through the shadow mask 8, and land on the fluorescent surface 4 on an inside surface of the panel 2, to make the fluorescent surface to emit a light.

The focus electrode 25 and the anode 26 collectively called as a main lens 200, and a related art main lens 200 will be explained with reference to FIG. 2. FIG. 2 illustrates a perspective view with a partial cut away view of the focus electrode 25 and the anode 26 in the main lens electrode.

Referring to FIG. 2, the focus electrode 25 is provided with a drum formed housing 252 externally, having an fore end facing the anode 26 with an opened central part and a rim 252*a* in a form of a racing track in a periphery, and a plate of electrostatic field controlling body 254 spaced a distance away inward from rim 252*a* with three electron beam pass through holes 254*a*, 254*b*, and 254*c* for passing the three electron beams from the cathodes. The anode 26 is also provided with a drum formed housing 262 having a rim 262*a* at one end, and an electrostatic field controlling body 264 with electron beam pass through holes 264*a*, 264*b*, and 264*c* inside thereof.

FIGS. 3*a* and 3*b* illustrate a plan view of the electrostatic field controlling bodies 254 and 264 of the focus electrode 25 and the anode 26, respectively.

Referring to FIGS. 3*a* and 3*b*, it can be known that the electron beam pass through holes 254*a*, 254*b*, and 254*c* in the electrostatic field controlling body 254 of the focus electrode 25 are similar, or identical to the electron beam pass through holes 264*a*, 264*b*, and 264*c*, respectively.

One of the most important parameter to be taken into account in design of an electron gun is a spot diameter Dt on a screen. There are three factors that influence the spot diameter on the screen, i.e., a magnification of the lens, a spatial charge repulsive power, and a spherical aberration of the main lens. Since voltage conditions, focal distances, a length of the electron gun, and etc., are already defined basically, the influence of the magnification of the lens to the spot diameter Dx has a small portion for utilizing as design parameter of the electron gun, and minimal effect.

The spatial charge repulsive power is a phenomenon in which the collision and repulsion between the electrons in the electron beam enlarge the spot diameter. For reducing enlargement of the spot diameter Dst caused by the spatial charge repulsive power, it is favorable to design an angle (a diverging angle) of the electron beam travel greater.

The spherical aberration of the main lens can form the smaller spot diameter on the screen, as the diverging angle of the electron beams is the smaller. In general, the spot diameter Dt on the screen may be expressed as a sum of three factors as follows.

$$D_t=\sqrt{(D_{x+D_{sl}})^2+D_{ic}}.$$

The best method for reducing the spherical aberration as well as the spatial charge repulsive power is enlargement of the main lens diameter, which reduces enlargement of the spot caused by the spherical aberration even if electron beams with a great diverging angle are incident thereon, and reduces the spatial charge repulsive power after electron beams pass through the main lens, thereby forming a small diametered spot on the screen. However, an enlargement of the rim, and spacing the distance from the rim to the electrostatic field controlling body greater for enlargement of the main lens diameter form the spot to be almost triangular with partial halo as a focusing of the outer main lens is in a 45° direction, with a difference between a central main lens side and an opposite side.

FIG. 4 illustrates the foregoing triangular spots S1 on the screen.

The rim 252*a* of the focus electrode 25 focuses the outer beam weak in a 45° direction on the central beam side, and strong in a 45° direction on an opposite side of the central beam side, to form a triangle greater vertically in the 45° direction on the central beam side, and smaller vertically in the 45° direction on an opposite side of the central beam side. There are halos on sides opposite to the central beam in 45° directions. Of course, though forms of the outer spots can be slightly corrected at the anode as the anode acts opposite to the focus electrode, since an action of the main lens is significantly greater at the focusing side than the acceleration side, eventually a state at the focusing side is maintained as it is, due to which, because spot is formed not circular at a periphery of a picture, realization of focusing for meeting requirements of high definition, large sized screen, flat screen, and wide angle is difficult.

Moreover, in comparison to the electron gun with circular outer spots, alignments between apertures of electrodes of electron gun and one sided halo inducing characteristic dependent on assembly of electron gun related to a flatness of the electrode are sensitive, assembly of the electron gun is unfavorable.

SUMMARY OF THE INVENTION

Accordingly, the present invention is directed to an electron gun in a CRT that substantially obviates one or more of the problems due to limitations and disadvantages of the related art.

An object of the present invention is to provide an electron gun in a CRT, which can enlarge a main lens diameter and form an excellent spot that is almost circular and has a reduced size.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun in a CRT includes a main lens electrode having a focus electrode and an anode for focusing electron beams emitted from cathodes onto a screen, an electrostatic field controlling body fitted in each of the focus electrode and the anode each having three electron beam pass through holes, wherein each of outer holes in the electrostatic field controlling body fitted to each of the focus electrode and the anode has a form of a combination of a circle and a rectangle with reference to a vertical axis through a center of the hole in a direction opposite for facing outer holes of the focus electrode and the anode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
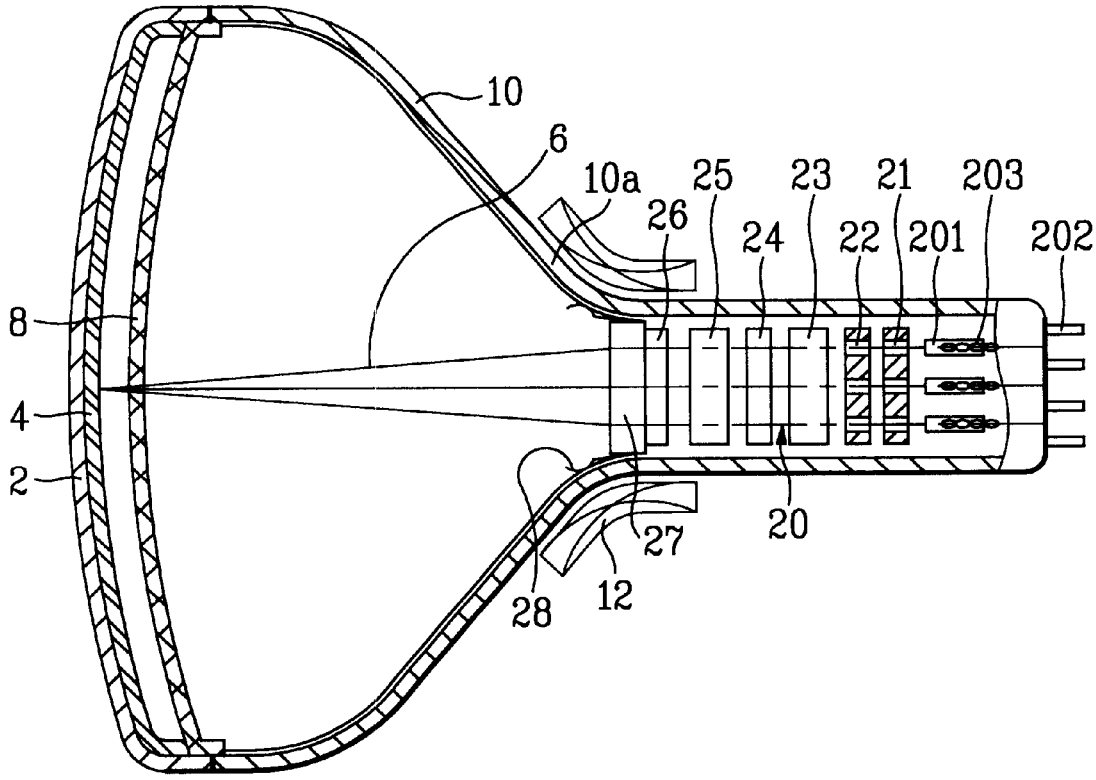
FIG.1 Related Art
FIG. 1 illustrates a section showing a related art CRT, schematically.
Figure 2:
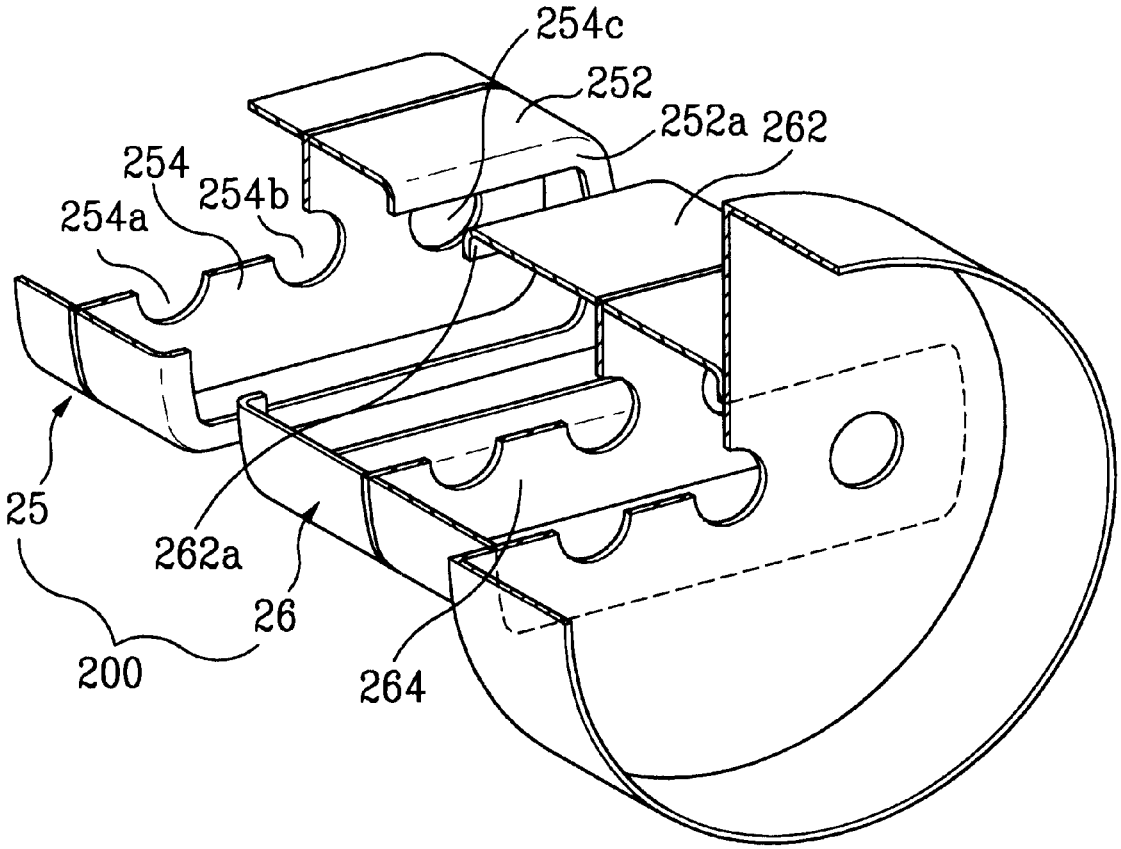
FIG. 2 Related Art
FIG. 2 illustrates a cut away perspective view showing a main lens part having a focus electrode and an anode in an electron gun of a related art CRT, schematically.
Figure 3A:
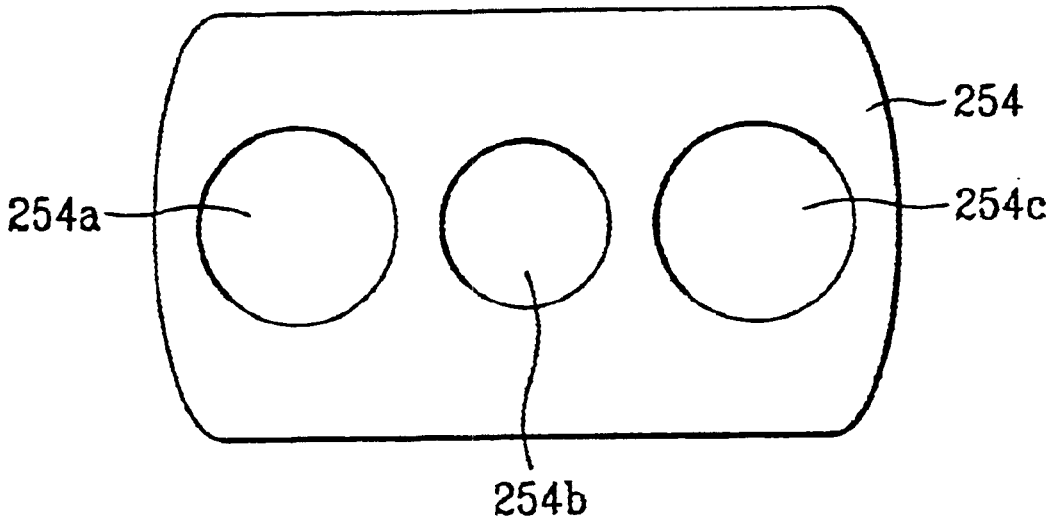
FIG.3a Related Art
FIGS. 3*a* and 3*b* illustrate plan views of electrostatic field controlling bodies of a related art focus electrode and an anode.
Figure 3B:
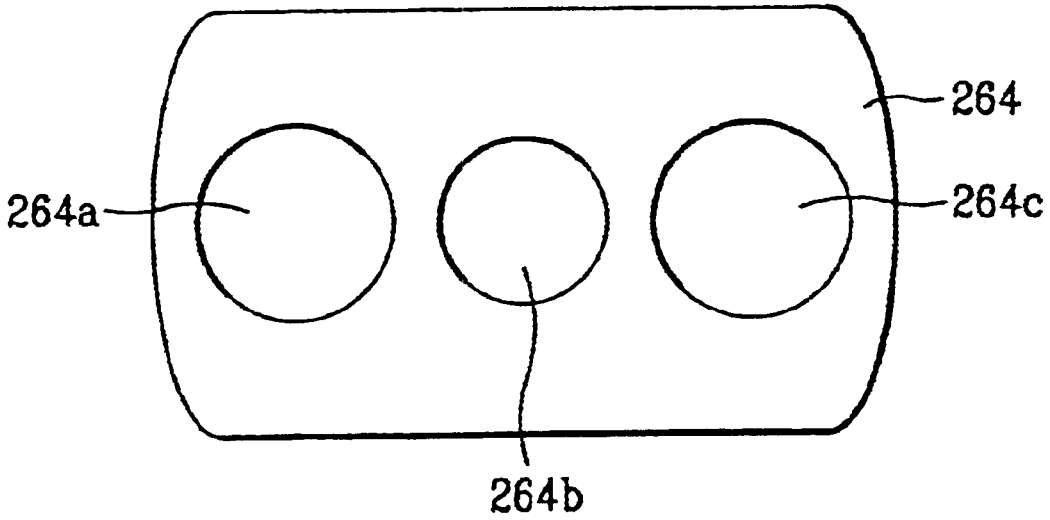
FIG.3b Related Art
Figure 5A:
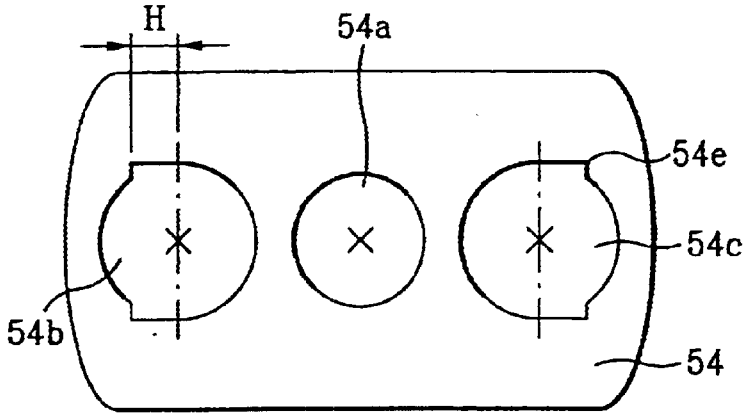
FIGS. 5*a* and 5*b* illustrate plan views of electrostatic field controlling bodies of a focus electrode and an anode in an electron gun of a CRT in accordance with a preferred embodiment of the present invention.
Figure 5B:
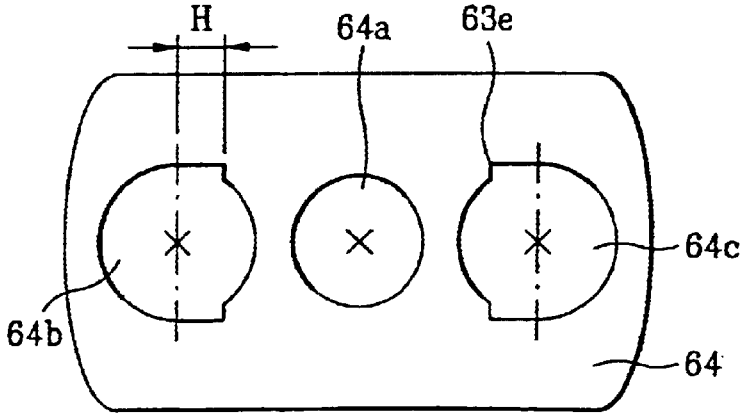

Reference will now be made in detail to the preferred embodiments of the present invention, examples of which are illustrated in the accompanying drawings. For reference, parts of the present invention identical to the related art will be given the same reference symbols. FIGS 5*a* and 5*b* illustrate plan views of electrostatic field controlling bodies of a focus electrode and an anode in an electron gun of a CRT in accordance with a preferred embodiment of the present invention. With regard to the related art main lens electrode, FIG. 2 will be referred.

An electrostatic field controlling electrode 54 provided to a focus electrode 25 is a planar electrode body fitted in an external housing 252 thereof spaced a distance away from a rim 252*a* having three electron beam pass through holes formed therein inclusive of central hole 54*a,* and outer holes 54*b* and 54*c*. The central hole 54*a* is circular, and the outer hole 54*b* or 54*c* is a combination of a circle and a rectangle.

Figure 4:
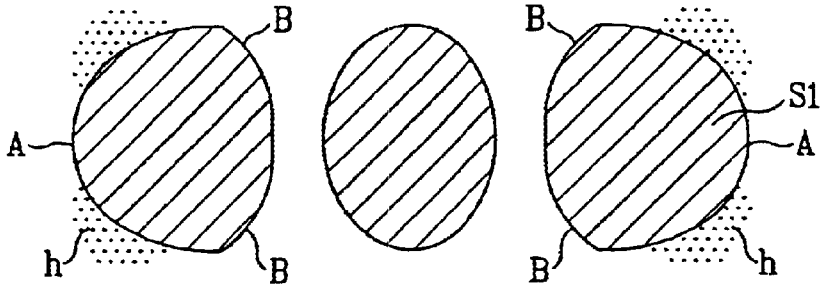
FIG.4 Related Art
FIG. 4 illustrates a plan view of spots on a screen in an electron gun of a related art CRT.

The outer hole 54*b* is a circle combined with a rectangle extended outward from a vertical axis of the circle, a height of which rectangle is the same with the diameter of the circle. The extended portion of the rectangle has a width 'H' at least smaller than a radius of the circle. Eventually, the electrostatic field controlling electrode 54 of the focus electrode has the outer hole with a rectangular part 54*e* projected in a direction opposite to the central hole with reference to a vertical axis of the outer hole, for improving the triangular spots in FIG. 4.

Referring to a lower drawing in FIGS 5*a* and 5*b*, similar to the electrostatic field controlling electrode 54 of the focus electrode, an electrostatic field controlling body 64 of an anode 26 includes one central hole 64*a* and two outer holes 64*b* and 64*c* each in a form of a combination of a circle and a rectangle, but a rectangular part 64*e* of the outer hole is extended toward the central hole with reference to a vertical axis of the outer hole. That is, the outer holes 54*b* and 54*c* in the electrostatic field controlling electrode 54 of the focus electrode 25 and the outer holes 64*b* and 64*c* in the electrostatic field controlling body 64 of the anode 26 are symmetry with respect to the vertical axis.

The operation of the electron gun improved by the present invention will be explained.

For compensating for the weak focusing power in a 45° direction on the central beam side at the rim 252*a* of the focus electrode 25, the rectangular part 54*e* is formed in the outer hole 54*b* or 54*c* in a 45° direction on an opposite side of the central beam side, for weakening a focusing power thereof to compensate for a difference of focusing powers in the rim.

Also, in a case it is intended to correct the problem that the outer spots are formed triangular on the screen, the electrostatic filed controlling body 64 in a form as shown in FIGS 5*a* and 5*b* is formed at the anode 26, and, for compensating a weakened diverging power in a 45° direction on the central beam side at the rim 262*a* of the anode 26, the rectangular part 64*e* is formed in the outer hole 64*b* or 64*c* in a 45° direction on the central beam side thereof in the electrostatic field controlling body 64, for compensating for a weakened diverging power.

Figure 6:
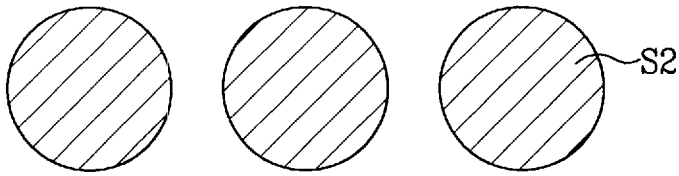
FIG. 6 illustrates a plan view showing spots on a screen formed by an electron gun of the present invention.

FIG. 6 illustrates a plan view of spots on a screen formed by an electron gun of the present invention. As can be known from the drawing, the electrostatic field controlling body 54 of the focus electrode 25 and the electrostatic field controlling body 64 of the anode 26 compensate for focusing powers of the outer beams, to form substantially circular spots, and to eliminate halos caused by a difference of focusing powers in the related art.

Figure 7:
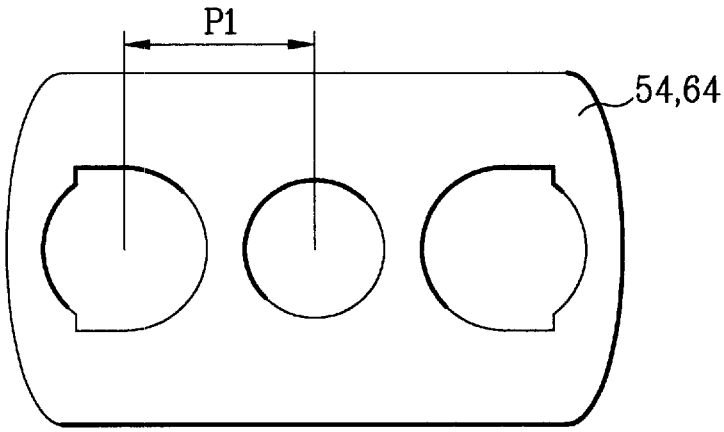
FIG. 7 illustrates plan views of an electrostatic field controlling body and a rim related to the present invention for comparison; and, FIG. 8 illustrates a graph showing a difference of horizontal diameters of main lenses according to a center distance P1 between a central hole and an outer hole of an electrostatic field controlling electrode of a focus electrode in a case a horizontal distance P2 between points from a center of the rim of the focus electrode to a point the rim changes from straight to curve is 5.5 mm.
Figure 7:
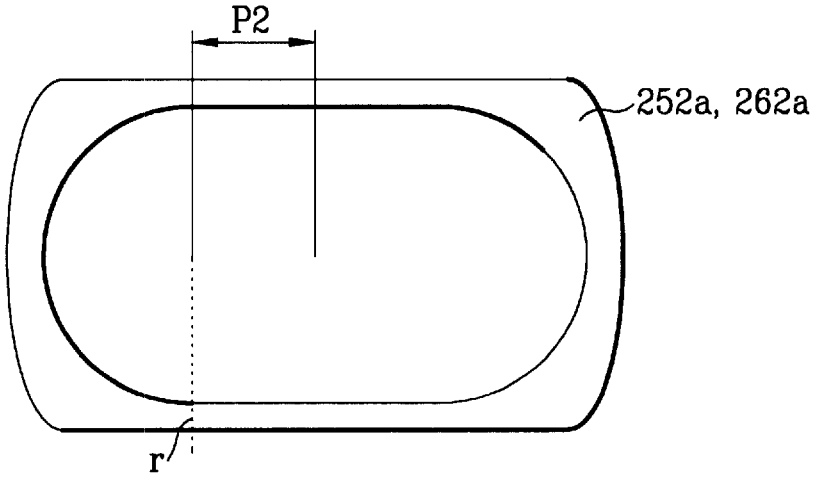

FIG. 7 illustrates, when the electrostatic field controlling bodies 54 and 64 in the focus electrode 25 and the anode 26 are formed deeper for increasing diameters of the main lenses, a distance P1 between centers of the central hole in the electrostatic field controlling body 54 or 64 of the focus electrode or the anode, and a horizontal distance P2 between points 'r' from a center of the rim 252*a* or 262*a* of the focus electrode or anode to a point of the rim changing from a straight line to a curved line.

In this instance, for compensation of a horizontal diameter difference of the main lenses in a central beam direction and an opposite direction of the central beam direction of the main lenses of the outer beams, as shown in FIG. 7, P1 is made greater than P2 (P1>P2). In this instance, after combination of the electrostatic field controlling bodies of the focus electrode and the anode, the spots are made circular. This is because the 45° direction focusing power difference of rims in the focus electrode is required to compensate the 45° direction focusing power difference of the electrostatic field controlling body in the anode as centers of the outer hole of the electrostatic field controlling electrode in the focusing electrode becomes far to weaken a correction power of the rectangular part 45° direction focusing power.

Figure 8:
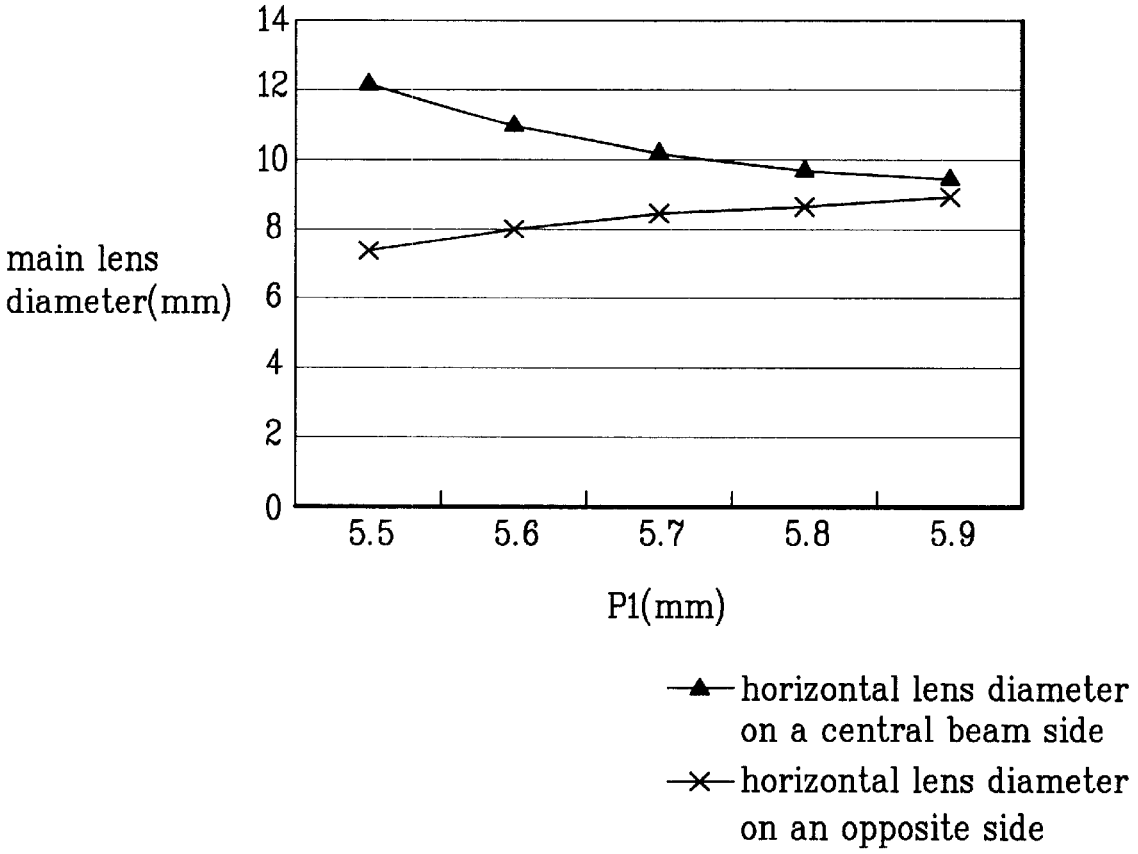

FIG. 8 illustrates a graph showing a difference of horizontal diameters of main lenses according to a center distance P1 between a central hole and an outer hole of an electrostatic field controlling electrode of a focus electrode in a case a horizontal distance P2 between points from a center of the rim of the focus electrode to a point the rim changes from straight to curve is 5.5 mm.

Referring to FIG. 8, as P1 becomes the greater than P2, it can be known that a horizontal lens diameter on the central beam side and an opposite horizontal lens diameter are in conformity. In the case of an embodiment of the electrostatic field controlling bodies of the present invention, by a simple additional step of forming the rectangular parts in the outer holes which are circular in the related art, improved spots can be formed on the screen without any complicated change to a related art process.

When an alignment of holes of the electron gun is adjusted in a beading process in which components of the electron gun are fixed with bead glass at preset distances in an electron gun assembly process, a jig called mandrel is used for holding the electrodes of the electron gun. In general, it is the most favorable that the mandrel has a circular section in view of alignment. Since the present invention permits to use the mandrel without change, the present invention is also favorable for the alignment.

By changing forms of outer holes in the electrostatic field controlling bodies for improving the outer spots caused by increased main lens diameters that give a great influence to a focus, an excellent focusing performance can be provided for entire screen. Since no change to an electron gun fabrication process is required, and round mandrel can be used, a favorable result can be obtained even in an electron gun alignment characteristic. Compared to a sensitive one sided halo characteristic caused by partial halo occurrence in the related art, a less sensitive result can be obtained even for the one sided halo which may be occurred by defective alignment of the electron gun.

It will be apparent to those skilled in the art that various modifications and variations can be made in the electron gun in a CRT of the present invention without departing from the spirit or scope of the invention. Thus, it is intended that the present invention cover the modifications and variations of this invention provided they come within the scope of the appended claims and their equivalents.

What is claimed is:

1. An electron gun in a CRT comprising:

a main lens electrode having a focus electrode and an anode for focusing electron beams emitted from cathodes onto a screen;

an electrostatic field controlling body fitted in each of the focus electrode and the anode each having three electron beam pass through holes, wherein each of outer holes in said electrostatic field controlling body has an appearance of a combination of a circle and rectangle taken from a view with reference to a vertical axis through a center of either of said outer holes in a direction opposite for facing outer holes of the focus electrode and the anode.

2. An electron gun as claimed in claim 1, wherein a horizontal distance P2 from a center of rim to a point on a rim of the focus electrode changing from a straight line to a curved line is greater than a center distance P1 of the central hole and the outer hole of the focus electrode.

3. An electron gun as claimed in claim 2, wherein the outer hole in the electrostatic field controlling body of the focus electrode has an appearance of a combined form of a circle and a rectangle in a view extended in a direction opposite to the central beam taken with reference to center of the circle as one axis.

4. An electron gun as claimed in claim 2, wherein the outer hole in the electrostatic field controlling body of the anode has an appearance of a combined form of a circle and a rectangle in a view extended in a direction of the central beam taken with reference to center of the circle as one axis.

* * * * *